US011541557B2

(12) United States Patent
She

(10) Patent No.: US 11,541,557 B2
(45) Date of Patent: Jan. 3, 2023

(54) FOLDING KNIFE APPARATUS AND METHOD

(71) Applicant: Hai Feng She, Yang Jiang (CN)

(72) Inventor: Hai Feng She, Yang Jiang (CN)

( * ) Notice: Subject to any disclaimer, the term of this patent is extended or adjusted under 35 U.S.C. 154(b) by 119 days.

(21) Appl. No.: 16/751,968

(22) Filed: Jan. 24, 2020

(65) Prior Publication Data

US 2021/0229298 A1 Jul. 29, 2021

(51) Int. Cl.
*B26B 1/04* (2006.01)

(52) U.S. Cl.
CPC ..... *B26B 1/046* (2013.01)

(58) Field of Classification Search
CPC ..... B26D 1/046; B26D 1/044; B26B 1/046; B26B 1/044; B26B 1/04; B26B 1/042
See application file for complete search history.

(56) References Cited

U.S. PATENT DOCUMENTS 6,079,106 A 6/2000 Vallotton
6,360,443 B1 * 3/2002 Remus ..... B26B 1/048 30/158
6,370,778 B1 * 4/2002 Conable ..... B26B 1/042 30/160
6,438,848 B1 * 8/2002 McHenry ..... B26B 1/048 30/160
6,523,265 B2 * 2/2003 Eickhorn ..... B26B 1/042 30/155
6,941,661 B2 * 9/2005 Frazer ..... B26B 1/048 30/160
7,062,857 B1 * 6/2006 Nenadic ..... B26B 1/042 30/298.4
7,107,686 B2 * 9/2006 Linn ..... B26B 1/02 30/159
7,146,736 B1 12/2006 Collins
7,676,932 B2 3/2010 Grice
7,905,022 B2 3/2011 Hawk
8,296,958 B1 10/2012 Frazer
10,035,272 B2 7/2018 Bruhns
2008/0307656 A1 * 12/2008 Lin ..... B26B 1/044 30/159
2010/0021263 A1 8/2010 Liu
2016/0279810 A1 * 9/2016 Demko ..... B26B 1/042

* cited by examiner

*Primary Examiner* — Evan H MacFarlane
*Assistant Examiner* — Liang Dong
(74) *Attorney, Agent, or Firm* — Walter J. Tencza, Jr.

(57) ABSTRACT

A folding knife including a blade assembly; a first plate; a first member; a spacer connected to a first end of the first member; and a first button connected to the first member between the first end of the first member and an opposing second end of the first member; wherein the spacer is configured to be inserted into a slot of the blade assembly to lock the blade assembly into an open orientation with respect to the first plate. The first member is configured to be rotated with respect to the first plate by the first button to allow the blade assembly to be unlocked. The first plate has an arcuate slot; wherein the arcuate slot is located closer to a first end of the first plate than to a second end; and wherein the first button is located between the arcuate slot and the second end.

14 Claims, 8 Drawing Sheets

FOLDING KNIFE APPARATUS AND METHOD

FIELD OF THE INVENTION

This invention relates to folding knives.

BACKGROUND OF THE INVENTION

There are various folding knives known in the art.

Nenadic, U.S. Pat. No. 7,062,857 discloses a folding knife 10 with a blade locking arm 18. (Nenadic, col., 2, lns. 32-42). The knife 10 includes a spring 30 for biasing the blade locking arm 18. (Id.) However, in Nenadic, knobs 90 used to manipulate blade 14 from a locked open state to a closed state, are located above and closely adjacent to blade coupling 16, and to blade 14. (Nenadic, col. 7, lns. 60-65; FIGS. 1-3). This means that an individual's fingers would be close to the rotating and sharp blade 14. (Id.) In addition, location of the knobs 90, above the typically large blade coupling 16, and related opening, only allow a small slot for movement of the knobs 90, also making changing from the completely open state to a closed state difficult. (Id.)

A better blade locking mechanism is needed.

SUMMARY OF THE INVENTION

In at least one embodiment of the present application, a folding knife is provided which includes a folding knife comprising: a blade assembly; a first plate; a first member; and a spacer connected to a first end of the first member; and a first button connected to the first member between the first end of the first member and an opposing second end of the first member; wherein the spacer is configured to be inserted into a slot of the blade assembly to lock the blade assembly into an open orientation with respect to the first plate; wherein the first member is configured to be rotated with respect to the first plate by the first button to allow the blade assembly to be unlocked from the open orientation with respect to the first plate, and to move into a closed orientation with respect to the first plate; wherein the first plate has an arcuate slot through which a pin moves when the blade assembly rotates with respect to the first plate; wherein the first plate has a length and a width, with the length of the first plate longer than its width, and wherein the length is the distance between a first end of the first plate and an opposing second end of the first plate; wherein the arcuate slot of the first plate is located closer to the first end of the first plate than to the second end of the first plate; and wherein the first button is located between the arcuate slot and the second end of the first plate.

In at least one embodiment of the present application, the first member has a first portion and a second portion; wherein the first portion of the first member has a height; wherein the second portion of the first member has a height; wherein the height of the second portion of the first member is approximately twice the height of the first portion of the first member; wherein the second portion of the first member is between the arcuate slot and the second end of the first plate; and wherein the first portion of the first member is above the arcuate slot.

In at least one embodiment of the present application, the folding knife further includes a second member having a first portion and a second portion which are identical to the first portion and the second portion, respectively, of the first member; wherein the second portion of the first member is between the arcuate slot and the second end of the first plate; and wherein the first portion of the first member is above the arcuate slot.

In at least one embodiment of the present application, the spacer may be connected to the second member; wherein the spacer spaces apart the first end of the first member from the first end of the second member; and wherein the second member is configured to be rotated with respect to the first plate by the first button to allow the blade assembly to be unlocked from the open orientation with respect to the first plate, and to move into a closed orientation with respect to the first plate.

In at least one embodiment of the present application, the second member is substantially the same as the first member, except the second member has two integrated legs, which are configured to be flexed towards each other when the first button is moved to allow the blade assembly to be unlocked from the open orientation with respect to the first plate, and to move into the closed orientation with respect to the first plate;

The second button may be connected to the second member between the first end of the second member and an opposing second end of the second member.

In at least one embodiment of the present application, a method is provided which includes inserting a spacer of a folding knife into a slot of a blade assembly of the folding knife to lock the blade assembly into an open orientation with respect to a first plate of the folding knife; and changing the folding knife from the open orientation with respect to the first plate to a closed orientation with respect to the first plate by moving a first button to cause the spacer to move out of the slot of the blade assembly. The folding knife may be constructed as previously provided.

DETAILED DESCRIPTION OF THE DRAWINGS

Figure 1:
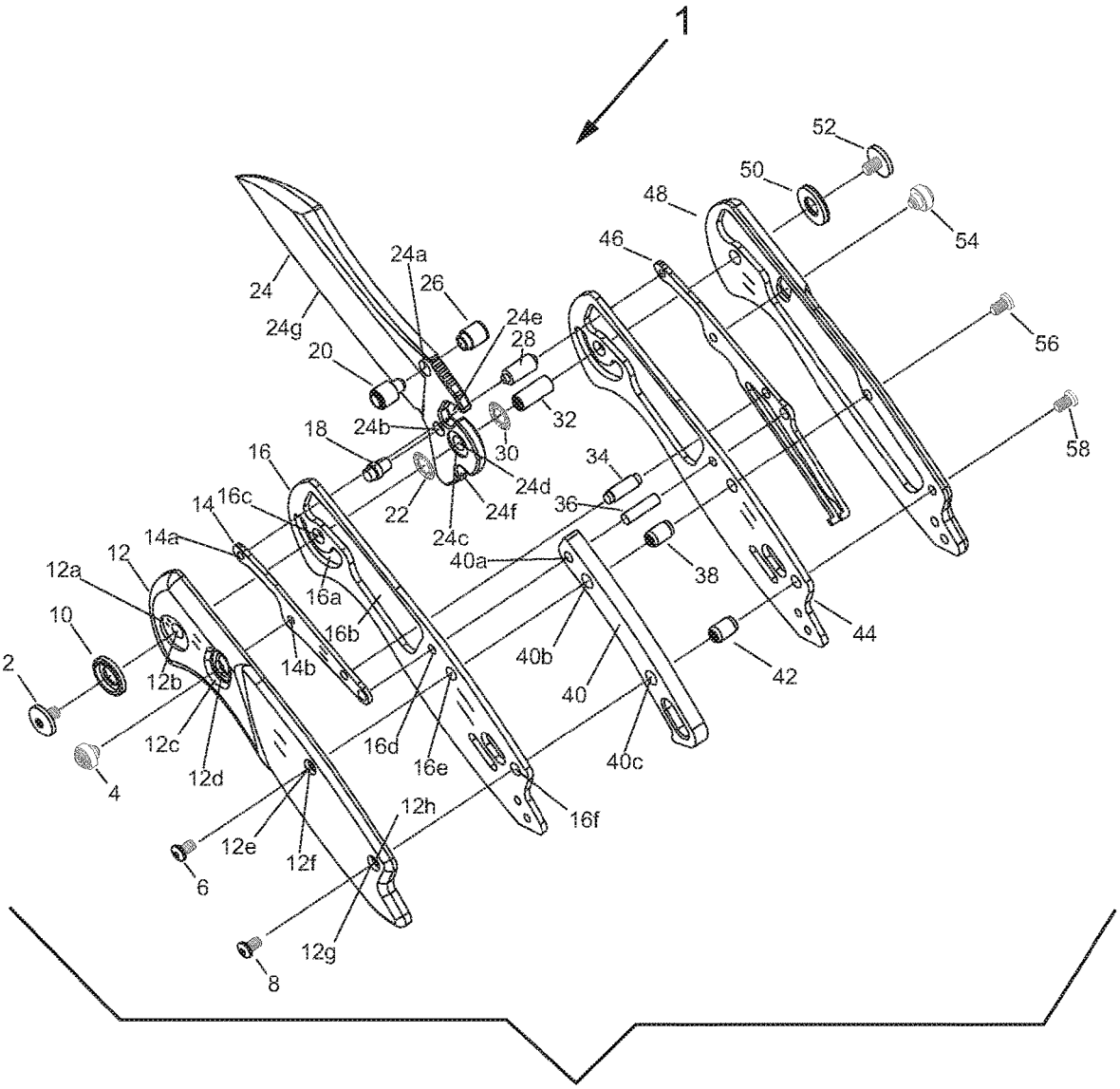
FIG. 1 is a top, left side, and rear view of a folding knife in accordance with an embodiment of the present invention, where the folding knife of FIG. 1 has been completely taken apart.
Figure 2:
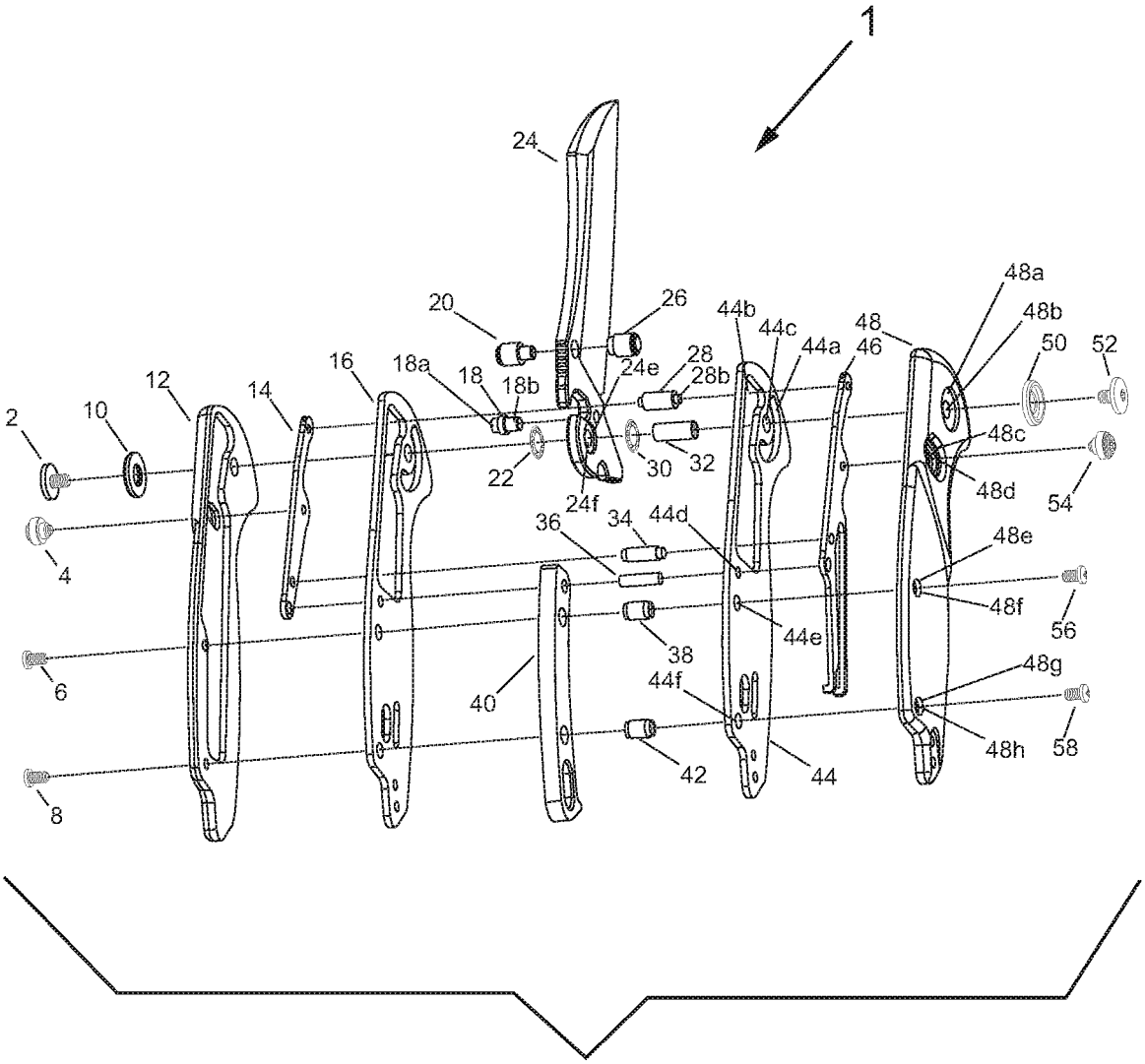
FIG. 2 is a top, right side, and rear view of the folding knife of FIG. 1, where the folding knife of FIG. 1 has been completely taken apart.

FIG. 1 is a top, left side, and rear view of a folding knife 1 in accordance with an embodiment of the present invention, where the folding knife 1 of FIG. 1 has been completely taken apart. FIG. 2 is a top, right side, and rear view of the folding knife 1 of FIG. 1, where the folding knife of FIG. 1 has been completely taken apart.

Referring to FIGS. 1 and 2, the folding knife 1 includes fasteners, screws or bolts, 2, 4, 6, and 8, washer 10, plate 12, member 14, plate 16, spacer 18, spacer 20, ball bearing 22, blade assembly 24, spacer 26, spacer 28, ball bearing 30, spacer 32, spacer 34, spacer 36, spacer 38, member 40, spacer 42, spring member 46, plate 48, washer 50, fasteners, screws or bolts 52, 54, 56, and 58.

Figure 3:
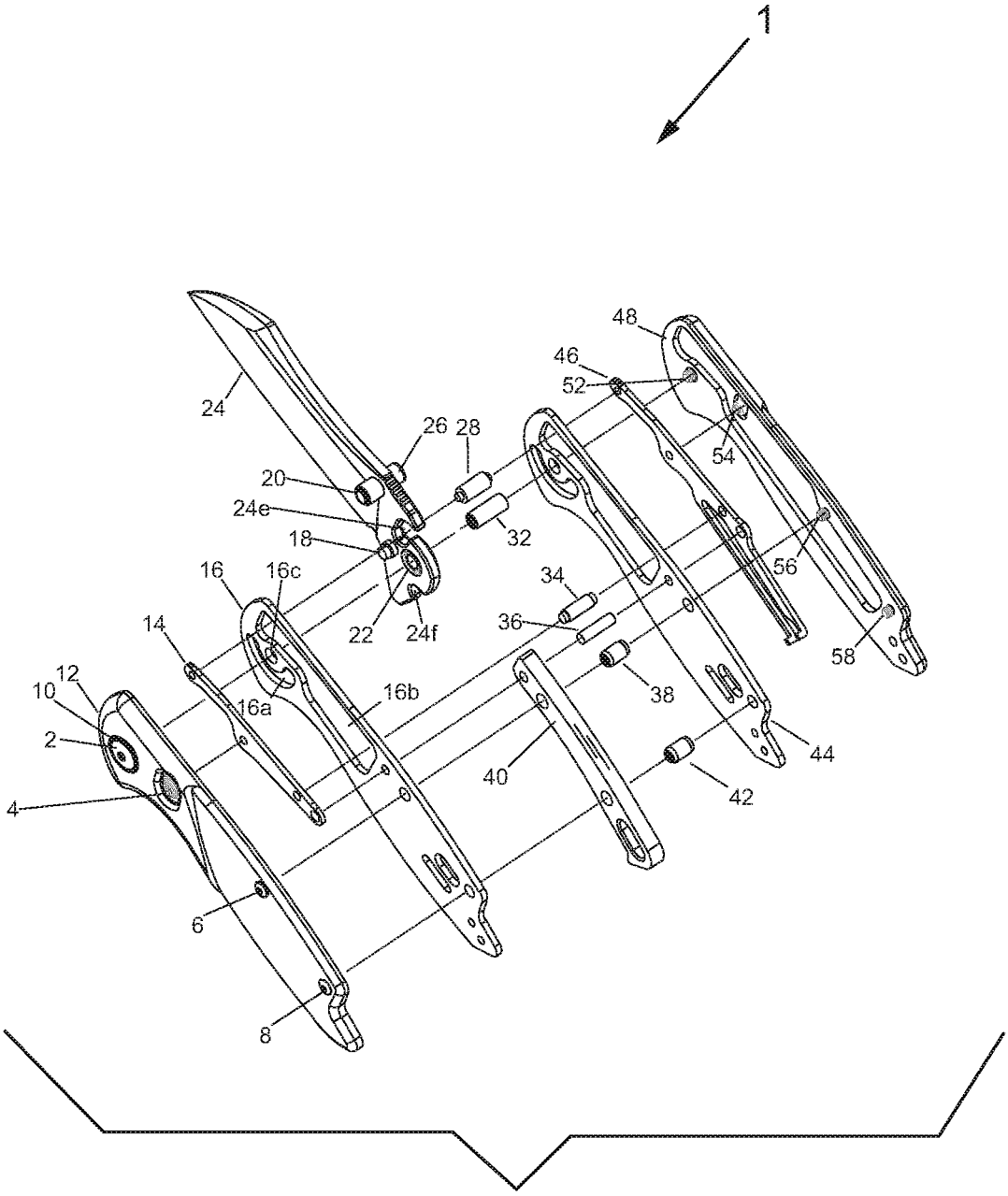
FIG. 3 is a top, left side, and rear view of the folding knife of FIG. 1 in a first partially assembled state.

FIG. 3 is a top, left side, and rear view of the folding knife 1 of FIG. 1 in a first partially assembled state. In FIG. 3, the washer 10 has been placed in a recess 12*a* (shown in FIG. 1) of the plate 12. The washer 10 has an outer diameter which is smaller than the diameter of the recess 12*a* but larger than an outer diameter of an opening 12*b* so that the washer 10 sits in the recess 12*a* without passing through the opening 12*b*.

In FIG. 3, a stem or threaded body portion of the fastener 2 has been inserted through a central opening of the washer 10 and then into the opening 12*b* (shown in FIG. 1) in the plate 12. The fastener 2 has a cap portion which fits into a recess of the washer 10 but has a diameter larger than the diameter of a central opening of the washer 10, and larger than the diameter of the opening 12*b*.

A stem or threaded body portion of the fastener, actuator, or button 4 has been inserted through an opening 12*d* (shown in FIG. 1) in the plate 12. A cap portion of the fastener, actuator or button 4 has a diameter which is smaller than the diameter of a recess 12*c* in the plate 12, but larger than a diameter of the opening 12*d*, so that the cap portion of 4 sits in the recess 12*c*. The recess 12*c* and the opening 12*d* are in the form of elongated slots to allow the fastener actuator or button 4 to slide back and forth, in the directions D1 and D2, shown in FIG. 7, in the opening 12*d* to slightly rotate member 14 about pivot pin or spacer 34. Movement of the button 4 in the direction D2, approximately perpendicular to an elongated length or axis of the plate 12, when the folding knife 1 is in the open state of FIG. 7, releases, the blade assembly 24, and allows the blade assembly 24 to be rotated with respect to the plate 12 into a closed state of FIG. 8. The button 4 falls back down in the direction D1 when the blade assembly 24 is rotated from the closed state of FIG. 8 back into the open state of FIG. 7.

In FIG. 3, a stem or threaded body portion of the fastener, screw, or bolt 6 is inserted into opening 12*f* (shown in FIG. 1), and a cap or head portion of fastener, screw, or bolt 6 sits in a recess 12*e* (shown in FIG. 1). The head or cap portion of 6 is larger than a diameter of the opening 12*f* but smaller than an outer diameter of the recess 12*e*. A stem or threaded body portion of the fastener, screw, or bolt 8 is inserted into opening 12*h* (shown in FIG. 1), and a cap or head portion of fastener, screw, or bolt 8 sits in a recess 12*h* (shown in FIG. 1). The head or cap portion of 6 is larger than a diameter of the opening 12*f* but smaller than an outer diameter of the recess 12*e*.

Figure 7:
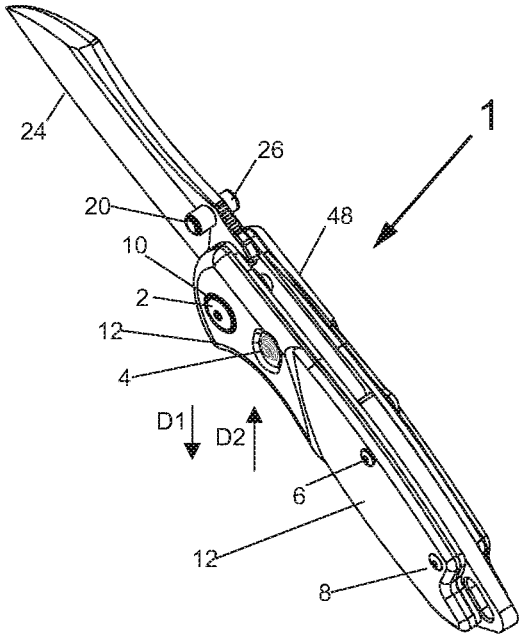
FIG. 7 is a top, left side, and rear view of the folding knife of FIG. 1 in a fully assembled state, with the blade assembly in an open orientation.

Each of the spacers 20 and 26 has a first cylindrical portion and a second cylindrical portion, and each first cylindrical portion is smaller in diameter than the respective second cylindrical portion. In FIG. 3, the first cylindrical portion of the spacer 20 is inserted into an opening 24*a* (shown in FIG. 1) of the blade assembly 24 and then connected the first cylindrical portion 26 of the spacer 26. When the folding knife 1 is fully assembled as in FIGS. 7 and 8, the combination of the spacers 20 and 26 are configured to be used to rotate the blade assembly 24 from the closed orientation with respect to the plate 12 of FIG. 8, to the open orientation with respect to the plate 12 of FIG. 7. An individual can push, pull, or otherwise move either or both the spacers 20 and 26 to cause rotation of the blade assembly 24 from the state of FIG. 8 to the state of FIG. 7. In at least one embodiment, the spacers 20 and 26 in FIG. 3 and in FIG. 7 are fixed to the blade assembly 24 so that the spacers 20 and 26 do not move and do not rotate with respect to the blade assembly 24 to provide firm protrusions for pushing or pulling, with one's finger or fingers to cause the blade assembly 24 to rotate from the closed orientation of FIG. 8 to the open orientation of FIG. 7. This prevents or inhibits a person's finger or fingers from slipping and accidentally being cut, by the sharp edge 24*g* of the blade assembly 24, when rotating the blade assembly 24 from a closed to an open orientation.

Spacer 18 has an inner cylinder portion, a central cylinder portion, and an outer cylinder portion. The inner cylinder portion of spacer 18 has a diameter which is less than the central cylinder portion, and approximately equal to a diameter of the outer cylinder portion. In FIG. 3, the inner cylinder portion of spacer 18 has been inserted into an opening 24*b* of the blade assembly 24. The outer cylinder portion of spacer 18 is shown inserted into an arcuate slot 16*a* of the plate 16 in FIG. 4, and the outer cylinder portion of spacer 18 moves in the arcuate slot 16*a* when the blade assembly 24 rotates with respect to the plate 12 and the folding knife 1 is fully assembled.

Figure 8:
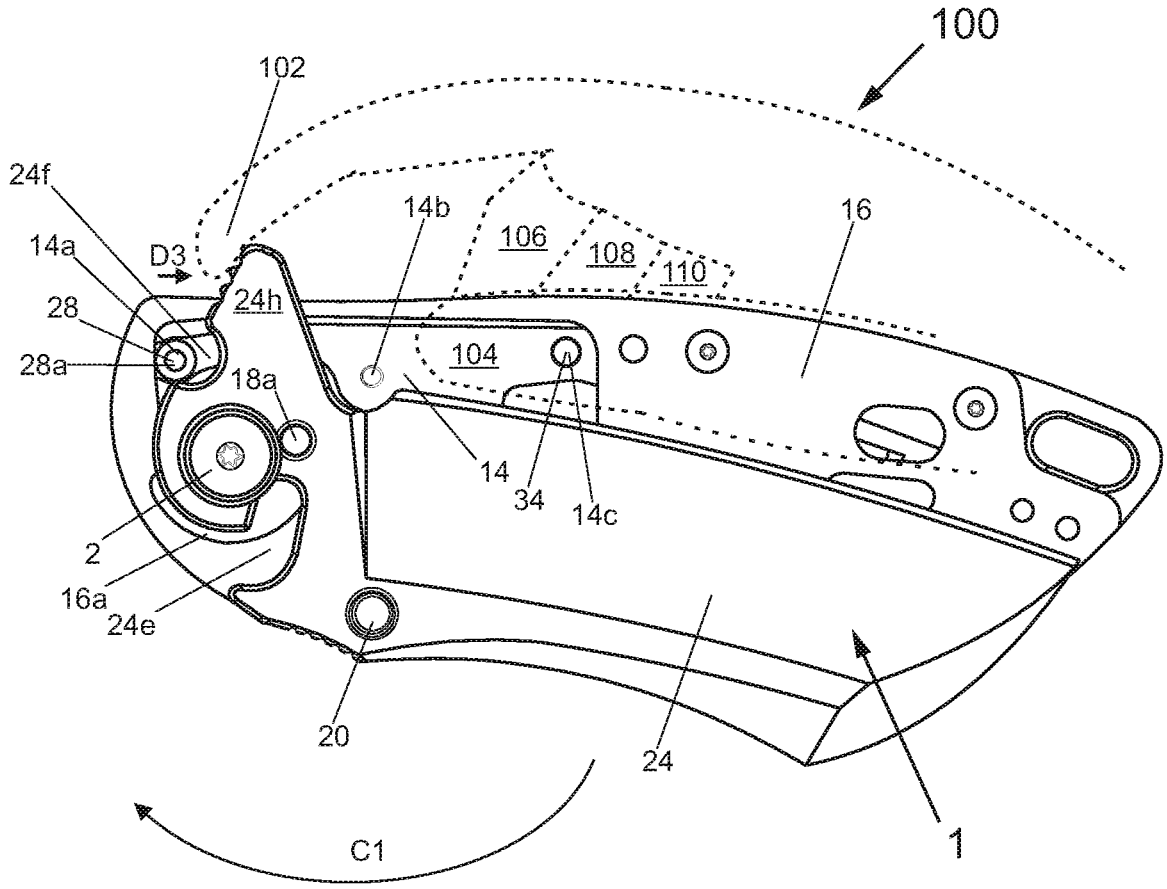
FIG. 8 is a left side view of the folding knife of FIG. 1 in a fully assembled state, in a closed orientation, with some of the components not shown, in order to explain operation.

FIG. 3 shows the ball bearing 22 inserted into a recess 24*c* (shown in FIG. 1) of the blade assembly 24 so that a central opening of the ball bearing 22 is aligned with a central opening 24*d* (shown in FIG. 1) of the blade assembly 24. The ball bearing 30, not shown in FIG. 3, in a fully assembled state of FIGS. 7 and 8, is inserted into a recess 24*e* (shown in FIG. 2) of the blade assembly 24 so that a central opening of the ball bearing 30 is aligned with a central opening 24*d* (shown in FIG. 2) of the blade assembly 24. The ball bearings 22 and 30 provide smooth movement, and reduce friction between the blade assembly 24 and other components, when the blade assembly 24 is rotated with respect to plate 12.

In FIG. 3, the washer 50, not shown, has been placed in a recess 48*a* (shown in FIG. 2) of the plate 48. The washer 50 has an outer diameter which is smaller than the diameter of the recess 48*a* but larger than an outer diameter of an opening 48*b* so that the washer 50 sits in the recess 48*a* without passing through the opening 48*b*.

In FIG. 3, a stem or threaded body portion of the fastener 52 has been inserted through a central opening of the washer 50 and then into the opening 48*b* (shown in FIG. 2) in the plate 48. The fastener 52 has a cap portion which fits into a recess of the washer 50 but has a diameter larger than the diameter of a central opening of the washer 50, and larger than the diameter of the opening 48*b*.

A stem or threaded body portion of the fastener, actuator, or button 54 has been inserted through an opening 48*d* (shown in FIG. 2) in the plate 48. A cap portion of the fastener, actuator or button 54 has a diameter which is smaller than the diameter of a recess 48*c* in the plate 48, but larger than a diameter of the opening 48*d*, so that the cap portion of 54 sits in the recess 48*c*. The recess 48*c* and the opening 48*d* are in the form of elongated slots to allow the fastener actuator or button 54 to slide back and forth, in combination with the button 4, to which it is fixed in a fully assembled state, in the directions D1 and D2, shown in FIG. 7, in the opening 48*d* to slightly rotate member 14 about pivot pin or spacer 34. Movement of the buttons 4 and 54 in the direction D2, approximately perpendicular to an elongated length or elongated axis of the plate 12, when the folding knife 1 is in the open state of FIG. 7, releases, the blade assembly 24, and allows the blade assembly 24 to be rotated with respect to the plate 12 into a closed state of FIG. 8. The buttons 4 and 54 fall back down in the direction D1 when the blade assembly 24 is rotated from the closed state of FIG. 8 back into the open state of FIG. 7.

In FIG. 3, a stem or threaded body portion of the fastener, screw, or bolt 56 is inserted into opening 48*f* (shown in FIG. 2), and a cap or head portion of fastener, screw, or bolt 56 sits in a recess 48*e* (shown in FIG. 2). The head or cap portion of 6 is larger than a diameter of the opening 48*f* but smaller than an outer diameter of the recess 48*e*. A stem or threaded body portion of the fastener, screw, or bolt 58 is inserted into opening 48*h* (shown in FIG. 2), and a cap or head portion of fastener, screw, or bolt 58 sits in a recess 48*h* (shown in FIG. 2). The head or cap portion of 56 is larger than a diameter of the opening 48*f* but smaller than an outer diameter of the recess 48*e*.

Figure 4:
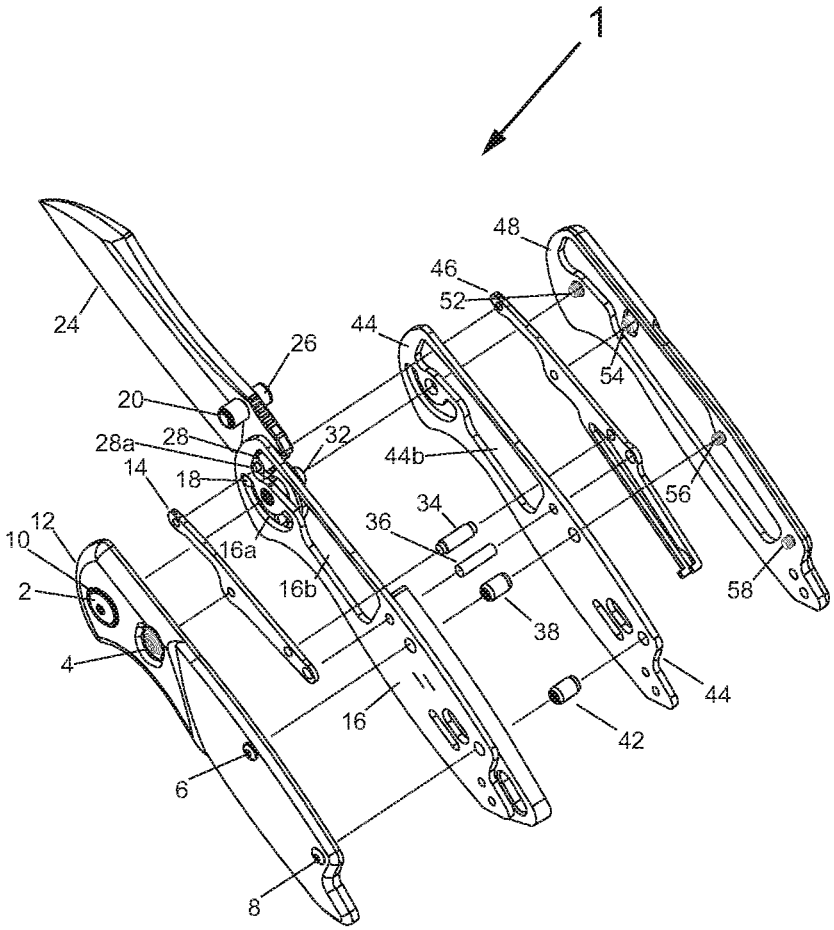
FIG. 4 is a top, left side, and rear view of the folding knife of FIG. 1 in a second partially assembled state, with a blade assembly in an open orientation.

FIG. 4 is a top, left side, and rear view of the folding knife 1 of FIG. 1 in a second partially assembled state, with the blade assembly 24 in an open orientation with respect to the plate 16. In FIG. 4, the outer cylinder of spacer 18 has been placed in the arcuate slot 16*a* and a pin or outer cylinder portion of spacer 28, is accessible through a gap or opening 16*b* in the plate 16. In addition, an opening 16*c* of the plate 16 is aligned, in FIG. 4, with the central opening of the ball bearings 22 and 30, the opening 24*d* shown in FIG. 1, and a central opening of the spacer 32. The spacer 32 has inner threads into which the threaded portions of the fasteners 2 and 52 are inserted to connect the outer plates 12 and 48, while allowing the blade assembly 24 to rotate with respect to the plates 12 and 48 in the fully assembled state In FIG. 4, the spacer 32 has been inserted into the central openings of the bearings 22 and 30, and the opening 24*d*.

In FIG. 4, openings 40*a*, 40*b*, and 40*c* of the member 40 have been aligned with openings 16*d*, 16*e*, and 16*f*, respectively, of the plate 16.

Figure 5:
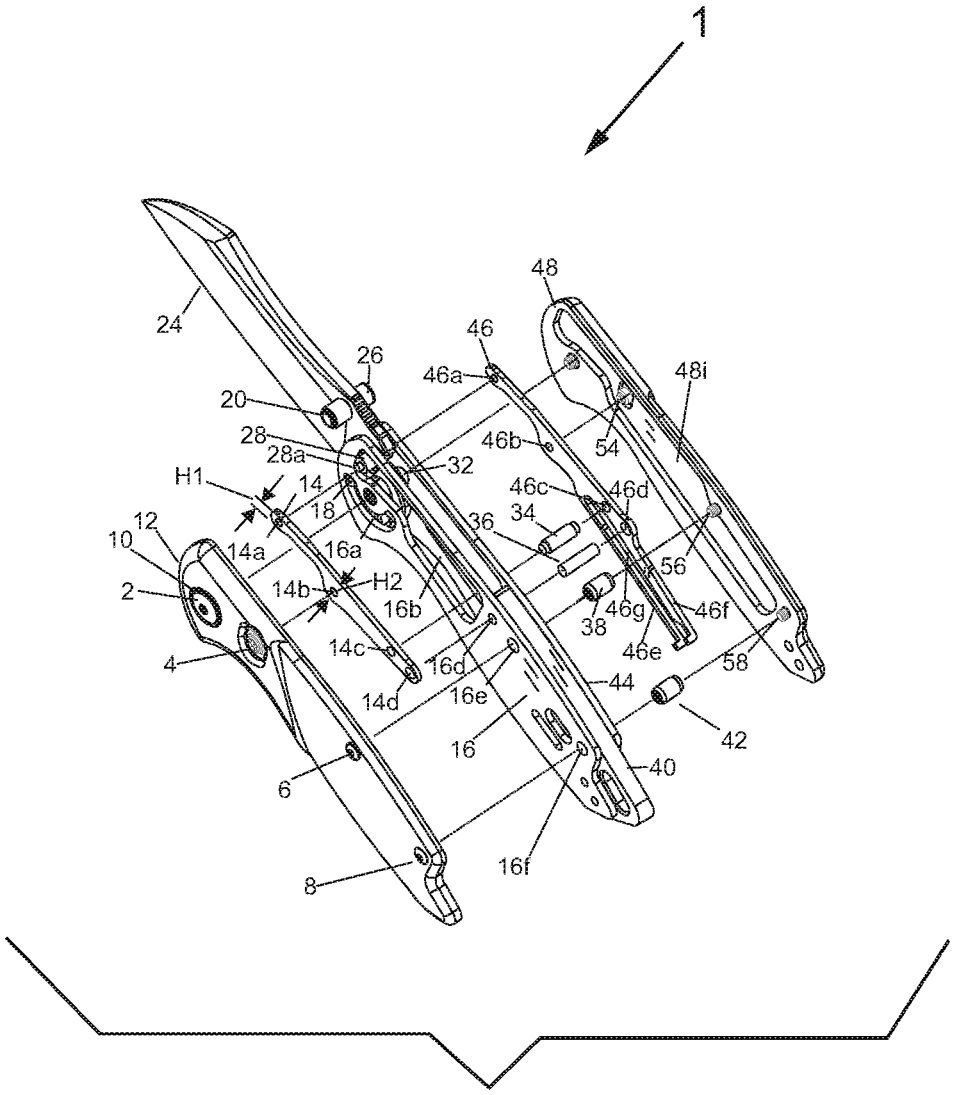
FIG. 5 is a top, left side, and rear view of the folding knife of FIG. 1 in a third partially assembled state, with the blade assembly in an open orientation.

FIG. 5 is a top, left side, and rear view of the folding knife 1 of FIG. 1 in a third partially assembled state, with the blade assembly 24 in an open orientation with respect to the plate 16. In FIG. 5, an outer cylinder or pin 18*b* of spacer 18 has been placed in the arcuate slot 44*a* (shown in FIG. 2) and a pin or outer cylinder portion 28*b* of spacer 28, is accessible through a gap or opening 44*b* in the plate 44. In addition, an opening 44*c* of the plate 44 is aligned, in FIG. 5, with the central opening of the ball bearings 22 and 30, the opening 24*d* shown in FIG. 1, and a central opening of the spacer 32. The spacer 32 has inner threads into which the threaded portions of the fasteners 2 and 52 are inserted to connect the outer plates 12 and 48, while allowing the blade assembly 24 to rotate with respect to the plates 12 and 48 in the fully assembled state. In FIG. 5, the spacer 32 has been inserted into the central openings of the bearings 22 and 30, and the opening 24*d*.

In FIG. 5, openings 40*a*, 40*b*, and 40*c* of the member 40 (shown in FIG. 1) have been aligned with openings 44*d*, 44*e*, and 44*f*, respectively, of the plate 44 (shown in FIG. 2).

Figure 6:
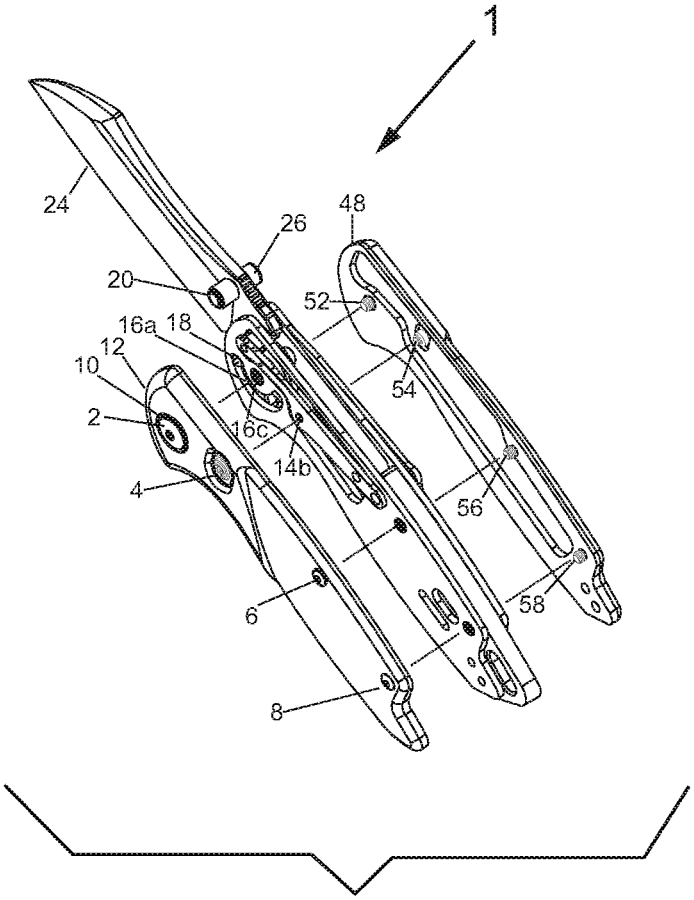
FIG. 6 is a top, left side, and rear view of the folding knife of FIG. 1 in a fourth partially assembled state, with the blade assembly in an open orientation.

FIG. 6 is a top, left side, and rear view of the folding knife 1 of FIG. 1 in a fourth partially assembled state, with the blade assembly 24 in an open orientation.

From FIG. 5 to FIG. 6, the pin or outer cylinder portion 28*a* of the spacer 28 has been inserted into opening 14*a* of the member 14; the pin or outer cylinder portion 28*b* (shown in FIG. 2) of the spacer 28 has been inserted into opening 46*a* of the member or spring 46; one end of the spacer 34 has been inserted into opening 14*c* of the member 14 and an opposing end of the member 34 has been inserted into opening 46*c* of the member 46; one end of the spacer 36 has been inserted into and through opening 16*d*, and then into opening 14*d* of the member 14 and an opposing end of the member 36 has been inserted into opening 46*d* of the member 46; the spacer 38 has been inserted into opening 16*e* of the plate 16; the spacer 42 has been inserted into the opening 16*f* of the plate 16; the member 14 has been placed in close proximity, and substantially parallel to the plate 16; and the member 46 has been placed in close proximity, and substantially parallel to the plate 44.

FIG. 7 is a top, left side, and rear view of the folding knife 1 of FIG. 1 in a fully assembled state, with the blade assembly 24 in an open orientation.

Referring to FIGS. 6 and 7, the plate 12 is connected to the rest of the folding knife 1, by inserting and screwing threaded portion of fastener 2 through opening 12*b*, through opening 16*c*, through and into threaded opening of spacer 32; inserting and screwing threaded portion of fastener 6 through openings 12*f*, 16*e*, 40*b*, and into threaded opening of spacer 38; and inserting and screwing threaded portion of fastener 8 through openings 12*g*, 16*f*, 40*c*, and into threaded opening of spacer 42. In addition, a threaded portion of fastener or button 4 is inserted through opening 12*d*, into opening 14*b* of the member 14.

Referring to FIGS. 32, 6, and 7, the plate 48 is connected to the rest of the folding knife 1, by inserting and screwing threaded portion of fastener 52 through opening 48*b*, through opening 44*c*, through and into threaded opening of spacer 32; inserting and screwing threaded portion of fastener 56 through openings 48*f*, 44*e*, 40*b*, and into threaded opening of spacer 38; and inserting and screwing threaded portion of fastener 58 through openings 48*g*, 44*f*, 40*c*, and into threaded opening of spacer 42. In addition, a threaded portion of fastener or button 4 is inserted through opening 12*d*, into opening 14*b* of the member 14.

FIG. 8 is a left side view of the folding knife 1 of FIG. 1 in a fully assembled state, with some of the components, such as the plate 12 missing, to allow other components to be viewed more easily; and, with the blade assembly 24 in a closed orientation, with respect to plate 16. In the closed orientation of FIG. 8, at least a portion of the spacer 28 sits in an approximately arcuate slot or gap 24*f* (shown in FIG. 1) of the blade assembly 24. To remove the spacer 28 from the gap 24*f*, a person pulls or pushes on the member 20 to rotate the blade assembly 24 in a clockwise direction C1 from the closed orientation of FIG. 8 to the open orientation of FIG. 7, with respect to the plate 16. The blade assembly 24 can be rotated in the clockwise direction C1 from the orientation of FIG. 8 until the spacer 28 is fully engaged in the slot or gap 24*e* shown in FIG. 8.

After the spacer 28 is fully engaged in the slot or gap 24*e* as in FIG. 7, the blade assembly 24 is locked in a fully open orientation with respect to the plate 16, and in order to unlock the blade assembly one needs to push up in the direction D2 shown in FIG. 7 on the button or fastener 4 (and/or the button or fastener 54, which moves in concert with fastener 4). Pushing up in direction D2 on button 4 and/or 54 causes the member 14 and at least a portion of member 46 to rotate with respect to the plates 12, 16, 44, and 48, and the attached spacer 28 to move upwards in the direction D2 out of the slot 24*e* or at least partially out of the slot 24*e*, and which also flexes the spring member sections or arms 46*e* and 46*f* (shown in FIG. 5) towards each other within a recess 48*i* (shown in FIG. 5) of the plate 48, and/or in an alternative embodiment within a similar or identical recess within plate 44, to allow the blade assembly 24 to rotate in a counterclockwise direction (opposite of C1), back to a closed orientation as in FIG. 8. Button 4 is not shown in FIG. 8, but would be aligned with the opening 14*b* which is shown. The members 14 and 46 pivot about pin or spacer 36, with respect to plate 12, plate 16, member 40, plate 44, and plate 48, referring to FIGS. 1 and 7, when the buttons 4 and/or 54 are pushed upwards in the direction D2 (shown in FIG. 7). Pushing the buttons 4 and/or 54 upwards in the direction D2, in addition, causes the extension 46*f* of the member 46 to be moved and/or compressed towards extension 46*e* of the member 46. The members 14 and 46 are connected through both pins 34 and 36, and through pin 28, so the portion of member 46 from the opening 46*d* to the end closest to opening 46*a*, moves together with movement of the member 14. In at least one embodiment, member 14 is substantially the same in shape and configuration as the portion of member 46 from the opening 46*d* to the end nearest the opening 46*a*. This configuration is preferred and critical to provide a balanced structure where either button 4 or button 54 or both can be moved upwards in the direction D2 (shown in FIG. 7), to unlock the blade assembly from the open orientation with respect to plate 12, plate 16, member 40, plate 44, and plate 48.

In at least one embodiment the member 14 is identical, and/or substantially similar to the member 46 except that member 46 has integrated extensions, arms, or legs 46*e* and 46*f*, which are compressed towards each other when button 4 and/or button 54 is or are pushed up in the direction D2, when the folding knife 1 is in the completely open orientation, and completely open state of FIG. 7. More particularly, in at least one embodiment, the leg or portion 46*f* of the member 46 shown in FIG. 5 flexes or moves towards the leg or portion 46*e*, when the buttons 4 and/or 54 are pushed up in the direction D2, from the orientation of FIG. 7. There is an elongated gap 46*g* between the leg portions 46*f* and 56*e* shown in FIG. 5. The elongated gap 46*g* is present in the fully open orientation and completely assembled state of FIG. 7. When the buttons 4 and/or 54 are pushed upwards in the direction D2, the leg 46*f* flexes or moves towards leg 46*e*, reducing the gap 46*g*, and exerting a restoring force on the member 14, and on at least a portion of the member 46 which is identical or substantially similar to the member 14. The compressed leg 46*f* or legs 46*f* and 46*e* provide a force similar to or identical to a spring force to bias the members 46 and 14 to lock the folding knife 1 in the open position of FIG. 7, and to cause the member 28 to move into the slot 24*f* in the closed state of FIG. 8.

In at least one embodiment, the openings 14*b* and 46*b*, and the button 4 shown in FIG. 5, and the button 54 shown in FIG. 1 are configured, when the folding knife 1 is completely assembled as in FIGS. 7 and 8, to be behind or to the rear of the slot 16*a*. In at least one embodiment, this is preferred, advantageous and critical to allow a person to push the buttons 4 and/or 54 further away from the blade 24 assembly, so that the person does not cut themself. In addition, the location of openings 14*b*, 46*b*, buttons 4 and 54, allows the slots or openings 12*c* and 48*c* to be larger which allows the buttons 4 and 54 to be larger, and portions of the members 14 and 46 to which the buttons 4 and 54 are attached to be larger, making it easier to manipulate and generally close the folding knife 1 from the state of FIG. 7 to the state of FIG. 8. In at least one embodiment, the member 14 has a thinner or lower height front portion which has an approximate height H1 shown in FIG. 5, and a thicker or greater height rear or central portion, to which the button 4 attaches, which has a height of H2 which may be about twice the height of H1. In at least one embodiment, the member 46 has identical or substantially similar dimensions to the member 14, except for the extensions or legs 46*e* and 46*f*.

In at least one embodiment, it is preferred and critical that the blade assembly 24 include a protrusion, such as triangular protrusion 24*h* shown in FIG. 8. The protrusion 24*h* can be pushed or pulled with someone's finger, applying force in the direction D3 shown in FIG. 8, to cause the pin 28*a* to come out of slot 24*f* and the blade assembly 24 to rotate in the direction C1 from the closed orientation in FIG. 8 with respect to plate 16 to an open orientation as in FIG. 7. In FIG. 8, a hand 100 of a person is shown in dashed lines. The hand 100 includes fingers 102, 106, 108, and 110, and thumb 104. The finger 102 is shown pulling the protrusion 24*h* in the direction D3 to apply force in that direction to cause the blade assembly to change from the closed orientation of FIG. 8 to the open orientation of FIG. 7, with respect to the plate 16. The fingers 106, 108, 110, and thumb 104 grip the plate 16 above the blade assembly 24.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A folding knife comprising:

a blade assembly;

a first plate;

a second plate;

a first member;

a second member;

a third member;

a pivot pin; and a first spacer having a first end and a second end; wherein the first end of the first spacer is connected to a first end of the first member; and a second spacer;

a first button connected to the first member between the first end of the first member and an opposing second end of the first member, such that when the first button is moved up and down, the first member is rotated, while the blade assembly remains in a fully open orientation with respect to the first plate;

wherein the first spacer is configured to be inserted into a slot of the blade assembly to lock the blade assembly into the fully open orientation with respect to the first plate;

wherein the first member is configured to be rotated with respect to the first plate by the first button to allow the blade assembly to be unlocked from the fully open orientation with respect to the first plate, and to move into a closed orientation with respect to the first plate;

wherein the first plate has an arcuate slot through which the second spacer moves in an arcuate path when the blade assembly rotates with respect to the first plate;

wherein the first plate has a length and a width, with the length of the first plate longer than its width, and wherein the length of the first plate is a distance between a first end of the first plate and an opposing second end of the first plate;

wherein the arcuate slot of the first plate is located closer to the first end of the first plate than to the second end of the first plate; and wherein the first button is located between the arcuate slot and the second end of the first plate;

wherein the second end of the first spacer is connected to a first end of the second member;

wherein the first spacer spaces apart the first end of the first member from the first end of the second member;

wherein the third member is between the first member and the second member and spaces apart the first member and the second member;

wherein the first member and the second member are connected to the third member so that the first member and at least a portion of the second member are configured to pivot simultaneously with respect to the third member, in response to movement of the first button up and down, about the pivot pin having a first end connected to the second end of the first member and an opposing end connected to a second end of the second member, wherein the second end of the second member opposes the first end of the second member;

wherein the second plate has a length and a width, with the length of the second plate longer than its width, and wherein the length of the second plate is a distance between a first end of the second plate and an opposing second end of the second plate;

wherein the second plate has a slot in which the first button moves up and down, wherein the slot of the second plate differs from the arcuate slot of the first plate and is spaced apart from the arcuate slot of the first plate along the lengths of the first and the second plates; and wherein the first plate and the second plate are fixed together such that the slot of the second plate is between the arcuate slot and the second ends of the first and the second plates.

2. The folding knife of claim 1 wherein the first member has a first portion and a second portion;

wherein the first portion of the first member has a height;

wherein the second portion of the first member has a height;

wherein the height of the second portion of the first member is twice the height of the first portion of the first member;

wherein the second portion of the first member is between the arcuate slot and the second end of the first plate; and wherein the first portion of the first member is above the arcuate slot.

3. The folding knife of claim 2 further comprising the second member has a first portion and a second portion which are identical to the first portion and the second portion, respectively, of the first member;

wherein the second portion of the second member is between the arcuate slot and the second end of the first plate; and wherein the first portion of the second member is above the arcuate slot.

4. The folding knife of claim 1 wherein the second member is configured to be rotated with respect to the first plate by the first button to allow the blade assembly to be unlocked from the fully open orientation with respect to the first plate, and to move into a closed orientation with respect to the first plate.

5. The folding knife of claim 1 wherein the second member has two integrated legs, which are configured to be flexed towards each other when the first button is moved to allow the blade assembly to be unlocked from the fully open orientation with respect to the first plate, and to move into the closed orientation with respect to the first plate; and further comprising a third plate having a recess in which the two integrated legs are located; and a fourth plate; and wherein the two integrated legs are located between the third plate and the fourth plate so as to prevent contacting the two integrated legs from outside of the folding knife.

6. The folding knife of claim 1 further comprising a third plate;

a second button connected to the second member between the first end of the second member and an opposing second end of the second member, such that when the second button is moved, the first member and at least part of the second member are rotated, while the blade assembly remains in a fully open orientation with respect to the first plate;

wherein the first member and at least part of the second member are configured to be rotated with respect to the first plate by the second button to allow the blade assembly to be unlocked from the fully open orientation with respect to the first plate, and to move into a closed orientation with respect to the first plate;

wherein the second button is opposite the first button; and wherein the second button is located between the arcuate slot and the second end of the first plate;

wherein the third plate has a length and a width, with the length of the third plate longer than its width, and wherein the length of the third plate is the distance between a first end of the third plate and an opposing second end of the third plate;

wherein the third plate has a slot in which the second button moves up and down, wherein the slot of the third plate differs from the arcuate slot of the first plate and is spaced apart from the arcuate slot of the first plate along the lengths of the first and the third plates;

wherein the first plate, the second plate, and the third plate are fixed together such that the slot of the third plate is between the arcuate slot and the second ends of the first, the second, and the third plates, and such that the slot of the second plate is aligned with the slot of the third plate.

7. The apparatus of claim 1 further comprising a third spacer;

wherein the first member has a length and a width, with the length of the first member longer than its width, and wherein the length of the first member is the distance between the first end of the first member and the opposing second end of the first member;

wherein the second member has a length and a width, with the length of the second member longer than its width, and wherein the length of the second member is the distance between the first end of the second member and the opposing second end of the second member;

wherein the first member is connected to the second member through a first connection, a second connection, and a third connection, wherein the first, second and third connections are spaced apart along the lengths of the first member and the second member;

wherein the first connection is through the first spacer;

wherein the second connection is through the pivot pin; and wherein the third connection is through the third spacer.

8. A method comprising the steps of:

inserting a first spacer of a folding knife into a slot of a blade assembly of the folding knife to lock the blade assembly into a fully open orientation with respect to a first plate of the folding knife; and changing the folding knife from the fully open orientation with respect to the first plate to a closed orientation with respect to the first plate by moving a first button to cause the first spacer to move out of the slot of the blade assembly;

wherein the folding knife is comprised of:

the blade assembly;

the first plate;

a second plate;

the first button;

a first member;

a second member;

a third member;

a pivot pin;

the first spacer having a first end and a second end, the first end of the first spacer connected to a first end of the first member; and a second spacer;

and wherein the first button is connected to the first member between the first end of the first member and an opposing second end of the first member, such that when the first button is moved up and down, the first member is rotated, while the blade assembly remains in the fully open orientation with respect to the first plate;

wherein the first member is configured to be rotated with respect to the first plate by the first button to allow the blade assembly to be unlocked from the fully open orientation with respect to the first plate, and to move into a closed orientation with respect to the first plate;

wherein the first plate has an arcuate slot through which the second spacer moves in an arcuate path when the blade assembly rotates with respect to the first plate;

wherein the first plate has a length and a width, with the length of the first plate longer than its width, and wherein the length is a distance between a first end of the first plate and an opposing second end of the first plate;

wherein the arcuate slot of the first plate is located closer to the first end of the first plate than to the second end of the first plate;

wherein the first button is located between the arcuate slot and the second end of the first plate;

wherein the second end of the first spacer is connected to a first end of the second member;

wherein the first spacer spaces apart the first end of the first member from the first end of the second member;

wherein the third member is between the first member and the second member and spaces apart the first member and the second member;

wherein the first member and the second member are connected to the third member so that the first member and at least a portion of the second member are configured to pivot simultaneously with respect to the third member, in response to movement up and down of the first button, about a pivot pin having a first end connected to the second end of the first member and an opposing end connected to a second end of the second member, wherein the second end of the second member opposes the first end of the second member;

wherein the second plate has a length and a width, with the length of the second plate longer than its width, and wherein the length of the second plate is a distance between a first end of the second plate and an opposing second end of the second plate;

wherein the second plate has a slot in which the first button moves up and down, wherein the slot of the second plate differs from the arcuate slot of the first plate and is spaced apart from the arcuate slot of the first plate along the lengths of the first and the second plates; and wherein the first plate and the second plate are fixed together such that the slot of the second plate is between the arcuate slot and the second ends of the first and the second plates.

9. The method of claim 8 wherein the first member has a first portion and a second portion;

wherein the first portion of the first member has a height;

wherein the second portion of the first member has a height;

wherein the height of the second portion of the first member is twice the height of the first portion of the first member;

wherein the second portion of the first member is between the arcuate slot and the second end of the first plate; and wherein the first portion of the first member is above the arcuate slot.

10. The method of claim 9 wherein the folding knife further includes:

the second member has a first portion and a second portion which are identical to the first portion and the second portion, respectively, of the first member;

wherein the second portion of the second member is between the arcuate slot and the second end of the first plate; and wherein the first portion of the second member is above the arcuate slot.

11. The method of claim 8 wherein the second member is configured to be rotated with respect to the first plate by the first button to allow the blade assembly to be unlocked from the fully open orientation with respect to the first plate, and to move into a closed orientation with respect to the first plate.

12. The method of claim 8 wherein the second member has two integrated legs, which are configured to be flexed towards each other when the first button is moved to allow the blade assembly to be unlocked from the fully open orientation with respect to the first plate, and to move into the closed orientation with respect to the first plate; and wherein the folding knife includes:

a third plate having a recess in which the two integrated legs are located; and a fourth plate; and wherein the two integrated legs are located between the third plate and the fourth plate so as to prevent contacting the two integrated legs from outside of the folding knife.

13. The method of claim 8 wherein the folding knife further includes:

a third plate; and a second button connected to the second member between the first end of the second member and an opposing second end of the second member, such that when the second button is moved, the first member and at least part of the second member are rotated, while the blade assembly remains in a fully open orientation with respect to the first plate;

wherein the first member and at least part of the second member are configured to be rotated with respect to the first plate by the second button to allow the blade assembly to be unlocked from the fully open orientation with respect to the first plate, and to move into a closed orientation with respect to the first plate;

wherein the second button is opposite the first button; and wherein the second button is located between the arcuate slot and the second end of the first plate;

wherein the third plate has a length and a width, with the length of the third plate longer than its width, and wherein the length of the third plate is the distance between a first end of the third plate and an opposing second end of the third plate;

wherein the third plate has a slot in which the second button moves up and down, wherein the slot of the third plate differs from the arcuate slot of the first plate and is spaced apart from the arcuate slot of the first plate along the lengths of the first and the third plates;

wherein the first plate, the second plate, and the third plate are fixed together such that the slot of the third plate is between the arcuate slot and the second ends of the first, the second, and the third plates, and such that the slot of the second plate is aligned with the slot of the third plate.

14. The method of claim 8 wherein wherein the first member has a length and a width, with the length of the first member longer than its width, and wherein the length of the first member is the distance between the first end of the first member and the opposing second end of the first member;

wherein the second member has a length and a width, with the length of the second member longer than its width, and wherein the length of the second member is the distance between the first end of the second member and the opposing second end of the second member;

wherein the first member is connected to the second member through a first connection, a second connection, and a third connection, wherein the first, second and third connections are spaced apart along the lengths of the first member and the second member;

wherein the first connection is through the first spacer;

wherein the second connection is through the pivot pin; and wherein the third connection is through a third spacer.

* * * * *